United States Patent [19]

Allred et al.

[11] Patent Number: 4,922,562

[45] Date of Patent: May 8, 1990

[54] RESCUE POUCH

[75] Inventors: Floyd R. Allred, Redmond; Gary A. Weible, Richland; Ronald L. Weible, Bellevue, all of Wash.

[73] Assignee: Western Group International, Bellevue, Wash.

[21] Appl. No.: 216,963

[22] Filed: Jul. 11, 1988

[51] Int. Cl.[5] ..... A61G 1/00

[52] U.S. Cl. ..... 5/82 R; 128/870

[58] Field of Search ..... 5/82 R, 413, 81 R, 174; 160/231.1, 231.2; 128/870; 182/163; 404/35

[56] References Cited

U.S. PATENT DOCUMENTS

| | | | |
|---|---|---|---|
| 1,151,495 | 8/1915 | Menten | 5/82 |
| 1,728,851 | 9/1929 | Blakely | 160/231.1 X |
| 1,925,574 | 9/1933 | Scott | 160/231.1 X |
| 2,279,694 | 4/1942 | Martinson | 5/82 |
| 2,350,573 | 6/1944 | Smith et al. | 5/82 |
| 2,367,167 | 1/1945 | Carpenter | 5/82 |
| 2,616,098 | 11/1952 | Love | 5/82 X |
| 3,314,200 | 4/1967 | Schuster | 5/82 |
| 3,742,526 | 6/1973 | Lillard | 5/465 X |
| 4,124,908 | 11/1978 | Burns et al. | 5/434 |
| 4,248,216 | 2/1981 | Glintz | 5/82 R |
| 4,649,583 | 3/1987 | Krueger | 5/446 X |

FOREIGN PATENT DOCUMENTS

| | | | |
|---|---|---|---|
| 522691 | 4/1931 | Fed. Rep. of Germany | 5/82 |

*Primary Examiner*—Alexander Grosz
*Assistant Examiner*—Michael J. Milano
*Attorney, Agent, or Firm*—H. Albert Richardson, Jr.

[57] ABSTRACT

A rescue pouch for transporting human bodies including a flexible container for the body and a pair of longitudinally oriented foldable beam supports which facilitate handling of the pouch yet permit it to be rolled for convenient storage.

17 Claims, 3 Drawing Sheets

2/3
Fig. 3
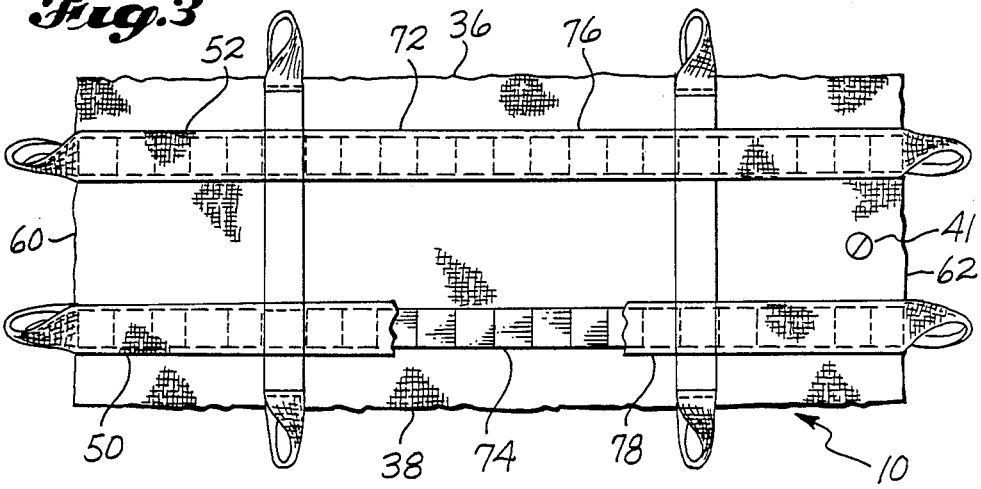
Fig. 6
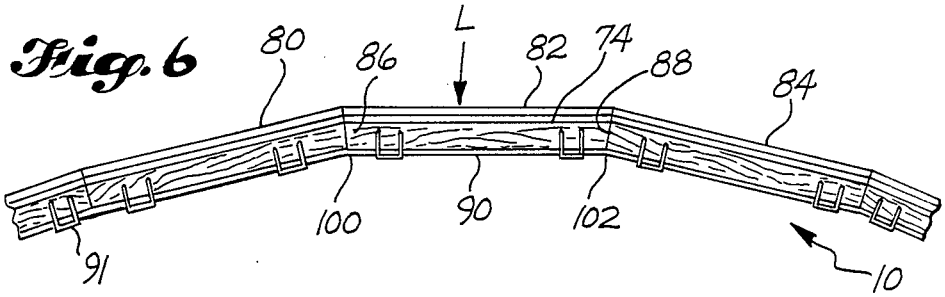
Fig. 7
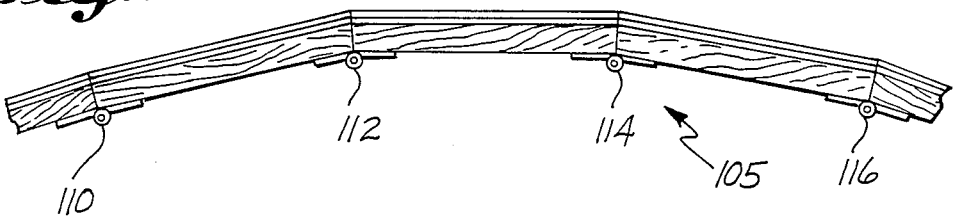
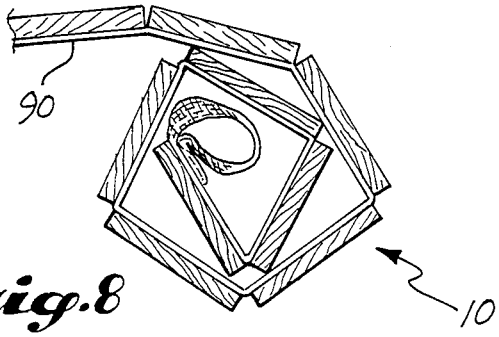
Fig. 8

RESCUE POUCH

This invention generally relates to transfer devices for human bodies and more particularly to a new longitudinally supported collapsible rescue pouch for the transport of the bodies of victims of disasters, or the like, living or dead.

In the event of a natural disaster or accident in which human beings are injured or killed, it is often necessary to transport the bodies of the victims from the places where their injuries occurred to a place where the injured can receive medical treatment and the dead can be properly identified and prepared for burial. The devices presently available for such use include body bags or disaster pouches, common stretchers or litters, and certain devices which combine the features of both. Body bags are relatively light in weight and easy to store but have a number of serious disadvantages. Because of their flexibility they are difficult to manage, particularly in rough terrain. Often, four men will be required to carry a single body bag from the injury site. Depending on the terrain it may be difficult for the rescuers to avoid dragging the bag on the ground or over obstacles which can result in further injury to the victim's body.

Ordinarily, as soon as the victim is moved to a convenient site his body is removed from the bag and placed on a stretcher to facilitate transportation. The process of removal can be very distasteful to the rescuers if the body is mutilated or decomposed and can be dangerous if the victim died of a contagious disease. Other disadvantages to body bags are that they are not usually designed to be disposable with the victim's body and are difficult to sanitize for reuse. Finally, because of their flexibility they are totally unsuitable for the transportation of injured persons.

Another common transportation device for bodies is the stretcher or litter. Its principal advantage is that it is relatively rigid and can be handled when loaded by two persons. Among its disadvantages are that it offers little protection for the body and is usually not appropriate for use if the body is mutilated or decomposed. Most are not collapsible and require an elongated storage space. When empty they are somewhat awkward to handle and normally can be carried only one at a time by. Finally, they are usually somewhat heavy and are not designed to be disposable.

Efforts have been made in the past to combine the advantages of the body bag and the stretcher but eliminate some of the undesirable features of both. For example, in order to provide rigidity, body bags have been provided with spars or shafts which run through loops along the back of the bag. Other bags have been made which incorporate rigid structures such as a common portable cot within the bag. For various reasons, however, all of these devices have failed to achieve widespread acceptance. Compared to body bags and stretchers they tend to be expensive and heavy. Because of the materials which they are made of they are not completely disposable through burning or cremation. Most are collapsible only to a limited degree. Finally, many have to be assembled by rescuers prior to use, which makes them impractical in situations where response time is critical.

Accordingly, it is an object of this invention to provide a rescue pouch which combines the advantages of the body bag and the stretcher while eliminating many of their inherent disadvantages.

It is a further object of this invention to provide for a rescue pouch which includes a unique longitudinal support member to facilitate handling and yet permit the pouch to be collapsed for compact storage.

It is an additional object of this invention to provide for a rescue pouch which is relatively inexpensive, lightweight, airtight, and completely disposable by burning or cremation.

SUMMARY OF THE INVENTION

The invention claimed can be broadly summarized as providing for a rescue pouch for transporting a human body which includes a flexible container capable of enclosing a human body and a foldable beam support which extends longitudinally along the container. The support includes a plurality of adjoining hinged elements which cooperate to form a beam and permit the pouch to be folded transversely for storage.

In accordance with a more detailed aspect of the invention, the rescue pouch further includes a tension strap connecting the elements and providing a hinge point between them.

According to another detailed aspect of the invention the rescue pouch includes means for securing the beam support to the container and permitting it to move longitudinally with respect to the container.

BRIEF DESCRIPTION OF THE DRAWINGS

FIGS. 2 and 3 are top and bottom views, respectively, of the same embodiment.

FIG. 5 is taken at 5—5 in FIG. 2.

FIG. 6 is a partial sectional view of the foldable support of the embodiment of FIG. 1.

FIG. 7 is a partial sectional view of the foldable beam support of a second embodiment of the present invention.

FIG. 8 is a partial sectional view of the embodiment of FIG. 1 illustrating how the rescue pouch can be rolled for convenient storage.

DESCRIPTION OF THE PREFERRED EMBODIMENTS

The novel features believed to be characteristic of this invention are set forth in the appended claims. This invention itself, however, may be best understood and its various objects and advantages best appreciated by reference to the detailed description below in connection with the accompanying drawings.

Figure 1:
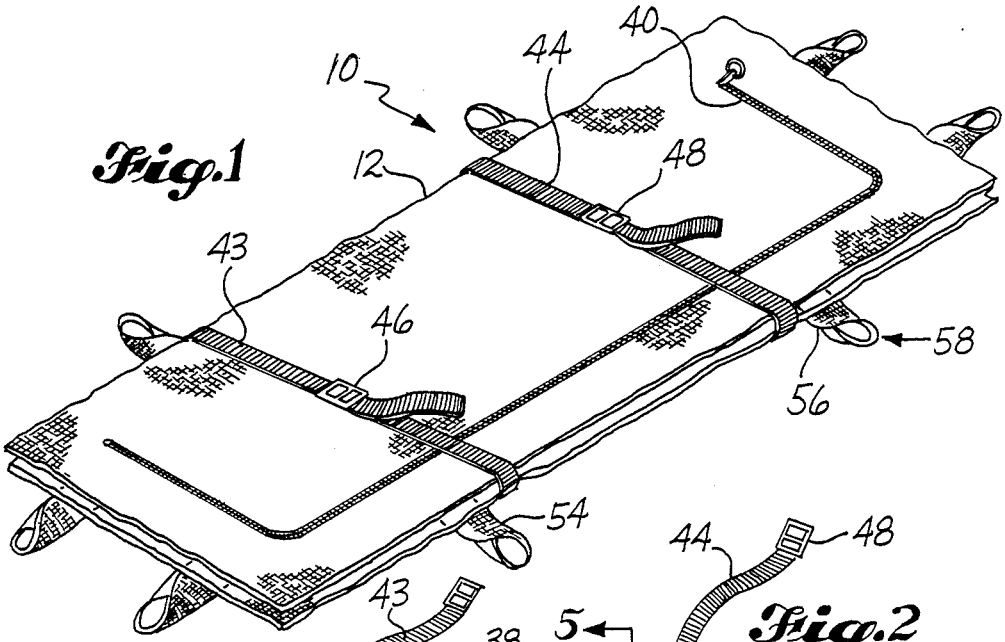
FIG. 1 is a perspective view of the first embodiment of the invention.
Figure 2:
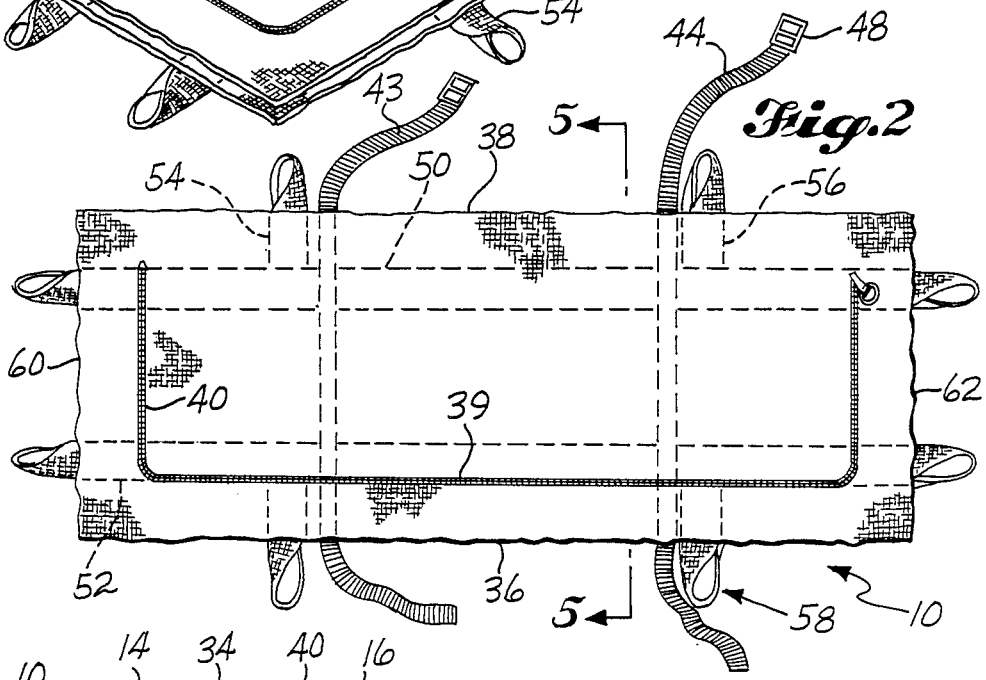
Figure 4:
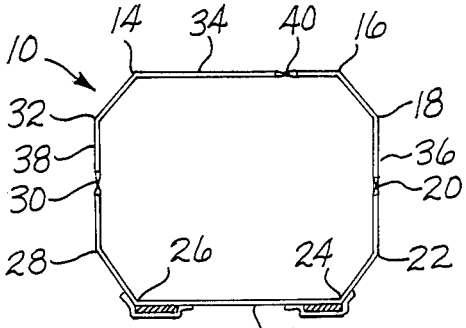
FIGS. 4 and 5 are cross-sectional views of the embodiment of FIG. 1 showing the container as it would appear when expanded and collapsed, respectively.
Figure 5:
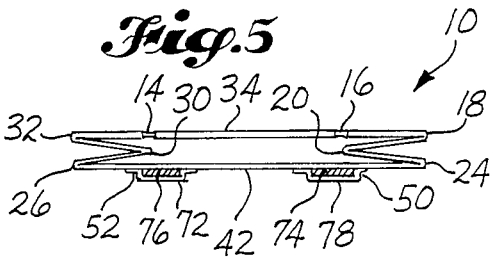

FIGS. 1 through 6 illustrate a first embodiment of the present invention generally designated in the drawings by the numeral 10. Referring to FIG. 1 it can be seen that this embodiment of the rescue pouch includes a flexible container 12 which, when viewed from the top, appears generally rectangular in shape and is capable of enclosing a human body. FIGS. 1, 2, and 5 illustrate the container as it would appear when collapsed and FIG. 4 is a cross-sectional view showing its configuration when fully expanded.

The container of FIG. 1 is preferably made of a water-proof, synthetic fabric, or plastic material formed to the appropriate shape. Alternately, other materials such as rubber could be used and the container could be constructed to include an insulation layer if desirable. In order that the container will readily collapse into, the compact configuration shown in FIG. 5, creases 14, 16, 18, 20, 24, 26, 30 and 32 are formed in it. Creases 20 and 30 are formed so that when upper surface 34 is forced downward, sides 36 and 38 will fold inward as shown in FIG. 5.

Access to the bag is provided through opening 39 in upper surface 34 and controlled by zipper 40. The zipper is preferably formed entirely from plastic but may be made of metal if desired. The design of the zipper should be such that the airtight and watertight features of the container will be retained. If the pouch is to be used to transport live victims it would be desirable to modify the zipper to provide a permanent opening for the victim's head. Such an opening would permit the victim to breath and would permit the rescuers to observe, reassure and communicate with the victim during rescue.

The pouch also includes sealable drain 41 located in lower surface 42 near end 62 of the container to permit the drainage of fluids such as blood or water.

Figure 12:
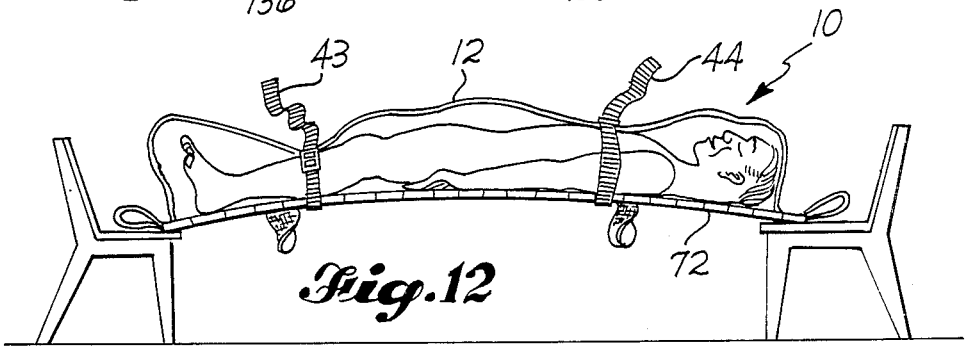
FIG. 12 is a sectional view of the embodiment of FIG. 1 containing a human body which illustrates the support provided by the invention.

Retaining straps 43 and 44 are attached to lower surface 42 and completely encircle the container. They are used to secure the victim's body within container and compress the container about the body as shown in FIG. 12. The straps include quick release plastic buckles 46 and 48 and are preferably made of synthetic fabric such as nylon.

Longitudinally oriented straps 50 and 52 and laterally oriented straps 54 and 56 are fastened to the bottom of the container, preferably by sewing or with a suitable adhesive, or both. In order to provide grips or handles by which rescuers can carry the rescue pouch, the ends of the straps have been extended beyond the edge of the container and formed into loops, of which loop 58 is typical. The straps may be made of any appropriate natural or synthetic fabric which is of adequate strength. With the straps positioned as shown in FIG. 2 the pouch may be transported by two rescuers positioned on opposing ends 60 and 62 of the container. If additional assistance is necessary either one or two rescuers may be added on opposite sides 36 and 38.

For the purposes of this application, the term "longitudinal" shall refer to a direction generally parallel to sides 36 or 38 of the container, and the term "lateral" shall refer to a direction generally parallel to ends 60 or 62.

A significant aspect of the invention is the longitudinal support structure secured to bottom side 42 of the container which provides longitudinal strength to the rescue pouch and permits it to be efficiently transported by two rescuers. That structure includes foldable beam supports 72 and 74 which are slidably mounted in longitudinal sleeves or envelopes 76 and 78, respectively. Those pouches are formed by securing the edges of straps 50 and 52 to the container bottom either by sewing or gluing, or both, as shown in FIG. 5. Alternately they could be molded in the bottom surface. It is desirable that each of the beam supports be able to slide longitudinally to a limited degree within its respective sleeve with respect to the container to facilitate the folding of the pouch, as will be discussed in greater detail below.

Each of the beams includes a series of adjoining blocks such as blocks 80, 82, and 84, illustrated in the partial sectional view of FIG. 6. Each of the blocks is preferably rectangular in shape when viewed from the top and has opposing beveled ends such as ends 86 and 88 of block 82. The blocks are connected by tension strap 90 which is preferably joined to the underside of each block by staples 91 and by gluing as shown in FIG. 6. Obviously, other commonly known fastening means may also be used to join the straps and blocks. When the strap and block assembly is positioned such that the adjoining end surfaces of the blocks are flush as shown in FIG. 6 the assembly forms an arch shaped beam.

When a victim is being transported in the rescue pouch, load is applied from the container to the upper surface of the beams in a downward direction as indicated in FIG. 6 by the arrow marked "L". As the beam is displaced downward under load a considerable tensile force is applied to the strap and an equal compressive force is generated in the blocks. Accordingly, the strap must be constructed of a material that can withstand substantial tensile stress, and similarly the blocks must be able to withstand a substantial amount of compression. Also, it is desirable that the beam supports not deflect downward excessively under load, so the strap and blocks should be constructed of materials which will not exhibit excessive strain or deflection under anticipated loads. It is also desirable that the materials be relatively durable, disposable and inexpensive. Finally, in order to facilitate folding of the rescue pouch the strap needs to be relatively flexible in bending at the points of intersection of the blocks, such as hinge points 100 and 102. Accordingly, it is preferred that the blocks be made of wood and the strap be made of a synthetic such as nylon.

FIG. 7 illustrates a second embodiment of the subject invention generally designated by the numeral 105 in which tension strap 90 has been replaced by a series of metal hinges of which hinges 110, 112, 114, and 116 are typical. Each of the hinges is fastened to adjoining blocks by means of screws or other fasteners adequate in size to withstand the shear forces generated in them when the pouch is loaded. Such hinges would have the advantage of being more durable than a fabric strap but would not be disposable under high heat.

It can be seen that the unique characteristic of the beam supports in each of the embodiments described above is that when it is loaded from above it will function as a beam, offering resistance to bending and supporting the load. On the other hand, if load is supplied from below, or opposite the direction indicated by the arrow in FIG. 6, the beam offers no such support and will simply fold at the hinge points. Accordingly, in this application a beam structure having this characteristic is referred to as a foldable beam support. The advantage of using such a support is that it will provide rigidity to the rescue pouch permitting it to be transported like a litter and yet will also permit it to be rolled up for compact storage. The partial sectional view of FIG. 8 illustrates a portion of the pouch in a partially rolled up condition.

Figure 9:
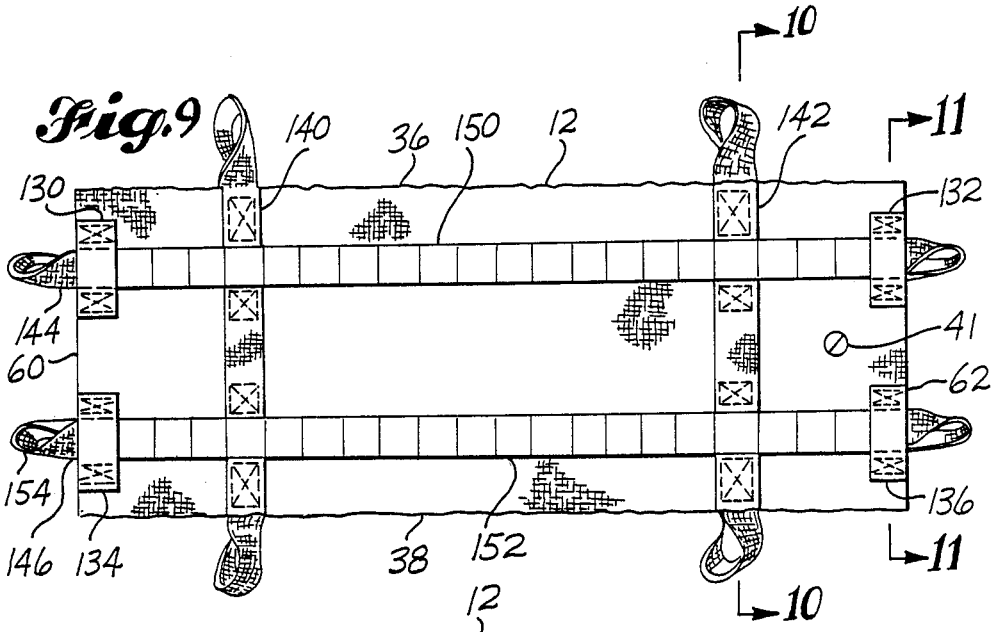
FIG. 9 is a bottom view of a third embodiment of the present invention.
Figure 10:
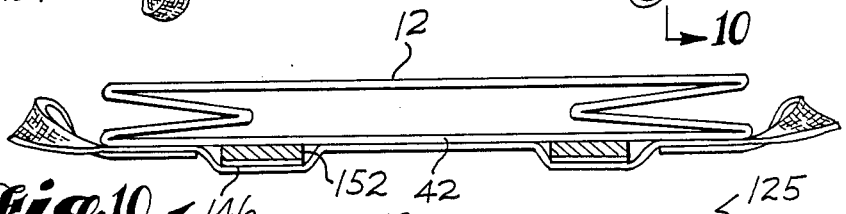
FIGS. 10 and 11 are sectional views taken at 10—10 and 11—11 respectively in FIG. 9.
Figure 11:
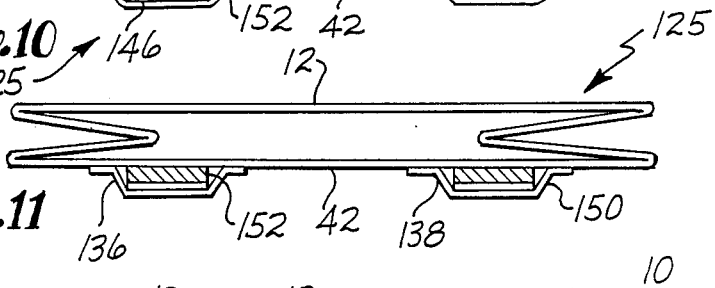

FIGS. 9 through 11 illustrates a third embodiment of the invention generally designated by the numeral 125 in which straps 50 and 52 have been eliminated and the support beams are retained to the container by loops 130, 132, 134, and 136, and by straps 140 and 142. In order to provide carrying handles, tension straps 144 and 146 of beam supports 150 and 152 are extended beyond the ends of the beams and formed into loops such as loop 154.

Thus it can be seen at the present invention provides for a rescue pouch which incorporates many novel features and offers significant advantages over the prior art. Although only three embodiments of this invention have been illustrated and described, it is to be understood that obvious modifications of it can be made without departing from the true scope and spirit of the invention.

We claim:

1. A rescue pouch for transporting a human body comprising:

a flexible container capable of enclosing a human body and including an opening through which the body can be inserted and means for closing the opening; and, a foldable beam support extending longitudinally along the container including a plurality of adjoining hinged elements defining a plurality of laterally oriented hinge axes, the elements cooperation to form a beam when the beam support is downwardly loaded and to permit the rescue pouch to be rolled about a substantially lateral axis for storage;

means for securing the beam support to the container and permitting it to move longitudinally with respect thereto; and, means for grasping the rescue pouch.

2. The rescue pouch of claim 1 wherein the beam support includes a tension strap connecting the elements and providing a hinge between adjoining elements.

3. The rescue pouch of claim 1 wherein the beam support includes a plurality of hinges, each connecting an adjoining pair of elements and providing a hinge point therebetween.

4. The rescue pouch of claim 2 wherein each of the plurality of elements has an upper surface adapted to contact the container and a lower surface to which the tension strap is attached.

5. The rescue pouch of claim 3 wherein each of the plurality of elements has an upper surface adapted to contact the container and a lower surface to which a hinge is attached.

6. The rescue pouch of claim 1 wherein the plurality of hinged elements have adjoining beveled ends and cooperate to form an upwardly arched beam when the rescue pouch is in an unrolled operating position.

7. The rescue pouch of claim 1 wherein the means for securing includes an elongated, longitudinally oriented sleeve attached to the container.

8. The rescue pouch of claim 1 wherein the means for securing includes a plurality of loops attached to the container.

9. The rescue pouch of claim 1 wherein the means for closing includes a zipper attached to the container.

10. The rescue pouch of claim 7 wherein the sleeve includes an end formed into a loop for grasping the pouch.

11. The rescue pouch of claim 2 wherein the tension strap includes an end formed into a loop for grasping the pouch.

12. The rescue pouch of claim 1 further including a laterally oriented strap attached to the pouch and having an end formed into a loop for grasping the pouch.

13. The rescue pouch of claim 1 including a second foldable beam support extending longitudinally along the container.

14. The rescue pouch of claim 1 further including means mounted in the container for draining fluid therefrom.

15. A rescue pouch for transporting a human body comprising:

a flexible container capable of enclosing a human body and including upper and lower surfaces, an opening through which the body can be inserted, zipper means for closing the opening, an elongated, longitudinally oriented sleeve attached to the lower surface of the container and having an end formed into a loop for grasping the pouch;

a foldable beam support extending longitudinally through the sleeve and including a plurality of elements having adjoining beveled edges and a tension strap connecting the elements and defining a plurality of laterally oriented hinge axes, the elements and the tension strap cooperating to form an upwardly arched beam when the beam support is downwardly loaded and permitting the pouch to be rolled about a substantially lateral axis for storage means for securing the beam support to the container and permitting it to move longitudinally with respect thereto; and, means for grasping the rescue pouch.

16. The rescue pouch of claim 1 wherein adjoining elements are hinged at the bottom of the elements.

17. The rescue pouch of claim 15 wherein adjoining elements are hinged at the bottom of the elements.

* * * * *